US005551565A

United States Patent [19]

Kendrick

[11] Patent Number: 5,551,565

[45] Date of Patent: Sep. 3, 1996

[54] BEVERAGE CAN CARRIER AND STORAGE DEVICE

[76] Inventor: Kathleen S. Kendrick, 21 Lincoln St., Weston, Mass. 02193

[21] Appl. No.: 389,279

[22] Filed: Feb. 9, 1995

[51] Int. Cl.[6] ..... B65D 65/00; B65D 75/00

[52] U.S. Cl. ..... 206/427; 206/202; 220/486; 294/159

[58] Field of Search ..... 206/427, 429, 206/430, 201, 202, 162; 220/486; 294/159; 211/13, 74, 76

[56] References Cited

U.S. PATENT DOCUMENTS

| | | | |
|---|---|---|---|
| 1,626,009 | 9/1927 | Murray | 220/486 X |
| 2,353,846 | 7/1944 | Power | 206/202 X |
| 2,981,440 | 4/1961 | Lilja | 206/202 |
| 4,300,697 | 11/1981 | Dickens | 220/486 |
| 4,542,826 | 9/1985 | Adams | 206/427 |
| 4,706,805 | 11/1987 | Becher | 206/144 |
| 4,735,313 | 4/1988 | Schoenberg | 206/427 |
| 4,738,363 | 4/1988 | Hudson | 206/427 |
| 4,883,169 | 11/1989 | Flanagan, Jr. | 206/170 |
| 4,901,857 | 2/1990 | Emerick | 206/427 |
| 5,009,315 | 4/1991 | Robare | 206/427 |
| 5,150,784 | 9/1992 | Sayad | 206/202 |
| 5,215,199 | 6/1993 | Bejarano | 211/74 |

*Primary Examiner*—Paul T. Sewell
*Assistant Examiner*—Tara L. Laster
*Attorney, Agent, or Firm*—William Nitkin

[57] ABSTRACT

A beverage can carrier and storage device formed of a wire form structure having an upper and lower channel, each with a vertically disposed entrance wherein the upper portion of each channel is bent at an approximately 45-degree angle to the vertically disposed lower portion of each channel for cans to pass through such entrance and down the angular portions of each channel to the vertical portion of the channels and in a first embodiment to be caught by cross members within the bottom portion of the structure for storage and carrying of the cans, and in a second embodiment without cross members at the bottom of the channels to allow the cans passing therethrough to fall into and be contained within a storage container disposed therebelow.

9 Claims, 4 Drawing Sheets

BEVERAGE CAN CARRIER AND STORAGE DEVICE

BACKGROUND OF THE INVENTION

1. Field of the Invention

The present invention resides in the field of wire-formed containers and more particularly relates to a wire-formed container for the storage and carrying of a plurality of empty beverage cans.

2. Description of the Prior Art

Dickens, U.S. Pat. No. 4,300,697 discloses a wire container for empty, returnable beverage cans formed from spaced-apart, horizontally disposed, rectangular wire frame members held together by a plurality of upright rods with a bottom hinged member to the lowermost frame member and biased to a closed position by a torsion spring. The cans are placed within columns formed by the wire-formed structure for transport. The cans can then be retrieved by opening the bottom member when desired. Flanagan, Jr., U.S. Pat. No. 4,883,169 also discloses a portable receptacle for the holding of a plurality of beverage cans between side walls which are spaced apart a distance approximately the diameter of a can with the cans disposed at an angle between such side walls, being stacked therein. The structure is foldable when there are no cans in position. Adams, U.S. Pat. No. 4,542,826 discloses yet another carrier for beverage cans also having a plurality of columns for the cans to be inserted on end, stacking one above the other. Becher, U.S. Pat. No. 4,706,805 discloses a top-loading carton made of a unitary sheet of disposable material in which the cans can be stacked on their sides, one above the other. Schoenberg, U.S. Pat. No. 4,735,313 discloses a plastic structure to receive a plurality of empty cans stacked on end, one above the other, within formed channels therein with a handle for transport. Emerick, U.S. Pat. No. 4,901,857 discloses a collapsible storage rack for holding beverage cans, one on top of the other within columns which are extendible as the frame members of the rack are raised in height and separated from one another.

The prior art demonstrates that it has been the goal of many inventions to provide means for a plurality of empty beverage cans to be conveniently stored and transported. Providing easy storage and transport of beverage cans has become very important in that many cans have deposits on them and must be returned to a store to obtain back the deposit. Also, home owners and others do not like the inconvenience of storing lightweight cans that can be easily scattered and fall over, making a mess in their kitchens or storage areas. As recognized in the prior art, it has been desirable for such storage to be accomplished in a neat fashion that also allows such cans to be easily transported back to the store for recycling purposes and for deposit returns.

It has also been an object of inventions of this type that littering be lessened by encouraging the proper disposal of beverage cans in suitable collection devices.

SUMMARY OF THE INVENTION

It is an object of this invention to provide an improved, durable carrying and storage device for beverage cans for both home, commercial and outdoor uses. The device of this invention uses a wire-formed structure which can be dipped into plastic so that it has no sharp edges and presents a smooth structure that is easy to handle.

It is a further object of this invention that beverage cans can be easily stored and transported therein, either in one unit or in a multiple of such units clipped together, and that in one embodiment such units can be conveniently placed under a kitchen sink or counter cabinet. To that end the initial embodiment of the structure described herein is designed to hold a dozen cans and can fit under a cabinet, such unit being less that 2 ft. in height. In use, one can open a cabinet door and easily insert an empty beverage can into the vertically disposed entrance to the channels of the device of this invention, causing the can to roll down the upper inclined portion of the channel, as will be described below, to the vertically upright portion of the channel where the can(s) will then be stacked one on top of the other on their sides until the stack in each channel reaches its respective channel entrance. At such time the device will then be full, and its door can be closed. The device of this invention has clips on its sides, allowing the wire frame of one to be clip-attached to the wire frame of the next so that a number of the carriers of this inventions can be clipped together and carried to recycling areas where the structures can be opened and inverted so that the cans will tumble out quickly. When full of cans, the device of this invention can be removed from under the counter and carried either to a store for return of deposit or to a recycling center where the cans can be processed for reuse of their metal content.

Other embodiments of the device of this invention can be utilized in commercial or non-home settings. In such embodiments the upright portion is elongated and can be of any height so that a multiplicity of cans can be positioned therein for later disposal. This embodiment provides for a very neat, open-air storage of cans within the channels of the device, as will be described below, and allows them to be easily transported. When it is desired to empty the container, the structure can be tilted/inverted for removal of the cans. Since the device is a wire-formed structure, it is extremely light in weight; and the addition of the weight of the empty beverage cans does not prevent the easy manipulation of the device for the removal of the cans from the structure once it has been filled.

In yet a further embodiment the structure of this invention can be use with other refuse receptacles. For example, the device of this invention can be attached onto the lid of a garbage can or a wire-frame receptacle holding a garbage storage bag thereunder to encourage the separation of beverage cans from non-recyclable trash. The structure of the present invention promotes the deposit of beverage cans therein but not other types of refuse. If other trash were introduced to the wire-formed entrances of the channels, the trash would fall straight down before it could enter the vertical upright portions of the channels. Thus the structure of this invention encourages only the storage of cans for recycling purposes and discourages the entry of other types of trash.

The wire structure of this invention can be plastic or epoxy-coated as described above and attracts attention to the structure when used as it is entertaining for individuals depositing beverage cans to watch the cans roll down the structure into place. This entertaining aspect of the device of this invention acts as a positive reinforcement to encourage individuals, including children, to recycle empty cans and discourages the natural tendancy to throw all types of refuse into a single trash bin. Recycling bins of the prior art have no means of preventing individuals from thoughtlessly throwing in different types of trash along with recyclable cans which are then improperly mixed with the beverage cans and which later must be manually separated, a task which is both messy and time-consuming. It is felt that providing the structure of this invention will cause individuals to be more inclined to separate recyclable beverage cans and to place empty cans within the structure of this invention. By using the carrier of this invention, the user receives a sense of satisfaction, order and control because it aids in solving the problem of recycling beverage containers in a neat and efficient way.

When using the the embodiment of the structure of this invention which holds 12 cans apiece, it is very easy to determine the number of cans returned by counting the number of beverage can carriers that are utilized so that the use of the structure of this invention eliminates the sorting and counting of wet or sticky cans that often results if the cans are held in bags. The cans will not fall inadvertently out of the device of this invention because its door can be snapped closed during transport thereof.

When the device of this invention is utilized in conjunction with a container having a plastic bag therein, the device can be disposed within the cover to such container. Such usage encourages the placement of beverage cans within the container. In some of these embodiments a door to the entrances of the channels would not be necessary since one would merely place the can within the opening entrance of either the upper or lower channel for the can to roll down the angular portion of the channel and then to fall down the upright portion of the channel directly into the structure therebelow whether it be a barrel or a plastic bag supported on a wire frame such that the unit does not require inverting to retrieve the cans. One would gain access to the cans by removing the cover to the container and the cans would be held within the plastic bag.

In one embodiment the structure of this invention two channels are provided which channels each have upper angular portions disposed at approximately a 45-degree angle, respectively, to two lower vertical portions, presenting two vertically disposed entrances for the entry of horizontally disposed cans. The structure of this invention is basically formed from three channel formers: a lower channel former which extends vertically upright a distance and then bends at an approximate 45-degree angle to form an angular portion thereof, a mid-channel former which extends vertically upright a distance and then bends at an approximate 45-degree angle to form an angular portion thereof, and an upper channel former which extends vertically upright a distance and then bends at an approximate 45-degree angle to form an angular portion thereof. Each channel former is disposed away from its adjacent channel former by a distance slightly greater than the diameter of the can to be deposited in the device, forming an upper channel between the upper channel former and the mid-channel former and a lower channel between the mid-channel former and the lower channel former. The entrances to the upper and lower channels are vertically disposed and the width of each entrance is slightly longer than the height of a beverage can. A plurality of wire central members in parallel alignment to the channel formers can be positioned within each channel former to prevent the cans from falling out the channels. When one utilizes the structure of this invention, for example, disposed under counters, bottom cross members catch the cans at the bottom of the channels. A plurality of side cross members are positioned along the left and right sides of the channel formers to prevent the cans from falling laterally out the channels. Channel guides are positioned vertically at each side of the entrances to the upper and lower channels and are spaced apart a distance slightly greater than the length of the can so that cans can easily be inserted and guided down the channels to their destination where they will either stack one upon the other or, if there are no cross members at the bottom of the structure, will fall into a storage container therebelow. A door can be provided to swing on the upper portion of the upper channel former and can latch by a catch member onto the upper portion of the lower channel former. A handle can be attached to central members of the upper channel former which can be used to carry the structure of this invention.

DESCRIPTION OF THE PREFERRED EMBODIMENT(S)

Figure 1:
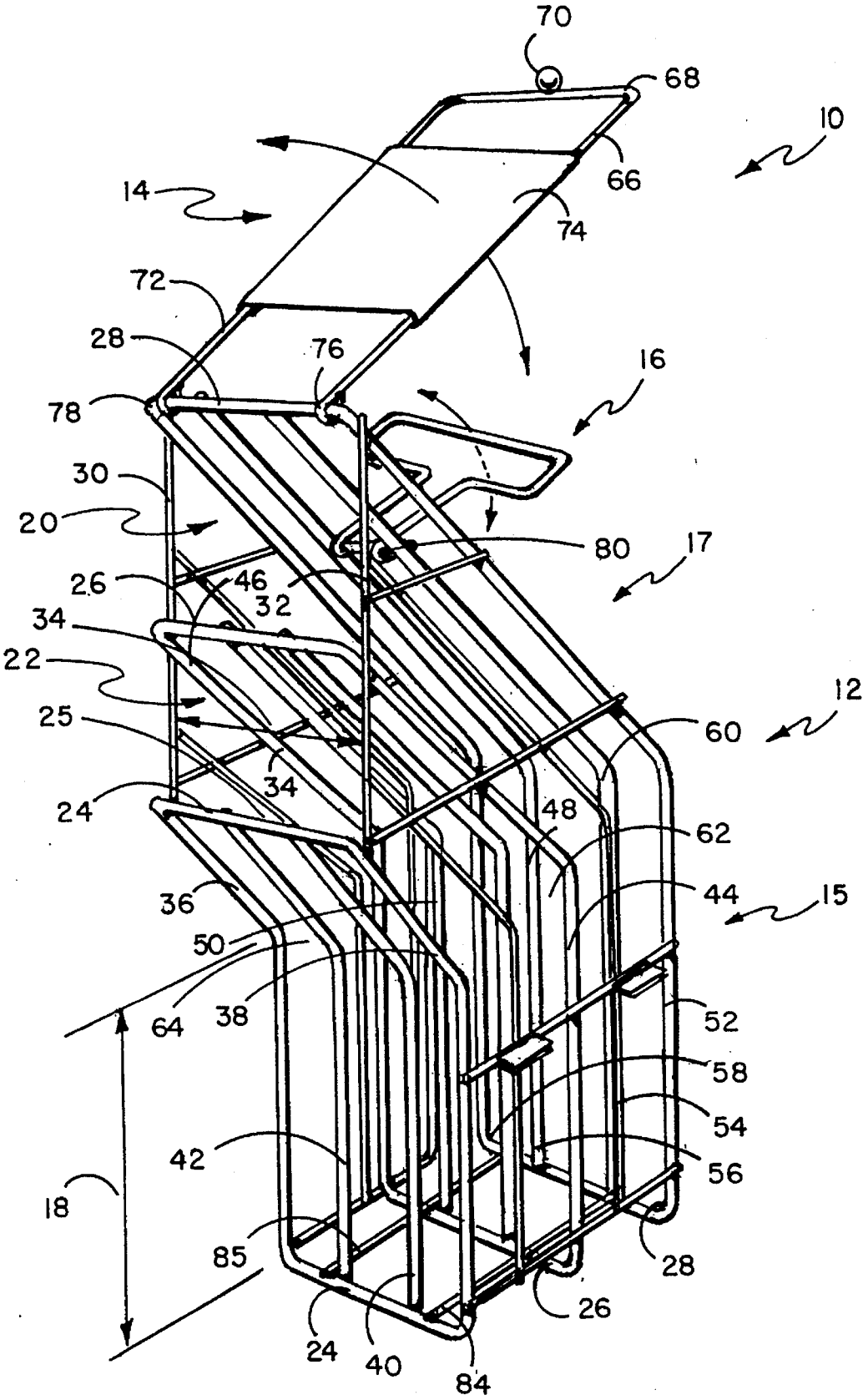
FIG. 1 illustrates a perspective view of the embodiment of the device of this invention of the type having a finite storage capacity for use, for example, in under-the-counter situations.

FIG. 1 illustrates a perspective view of the beverage can carrier and storage device 10. Illustrated is the embodiment of the structure for the holding of a finite number of beverage cans, such as twelve cans, for placement, for example, under a sink or kitchen counter. Seen in this view are lower channel former 24, mid-channel former 26 and upper channel former 28 which form can storage portion 12 of the device consisting of lower upright portions 15 forming a first and second channels and angular channel portions 17 extending from the tops thereof at an approximate 45-degree angle forward therefrom, having an upper channel entrance 20 and lower channel entrance 22.

Figure 3:
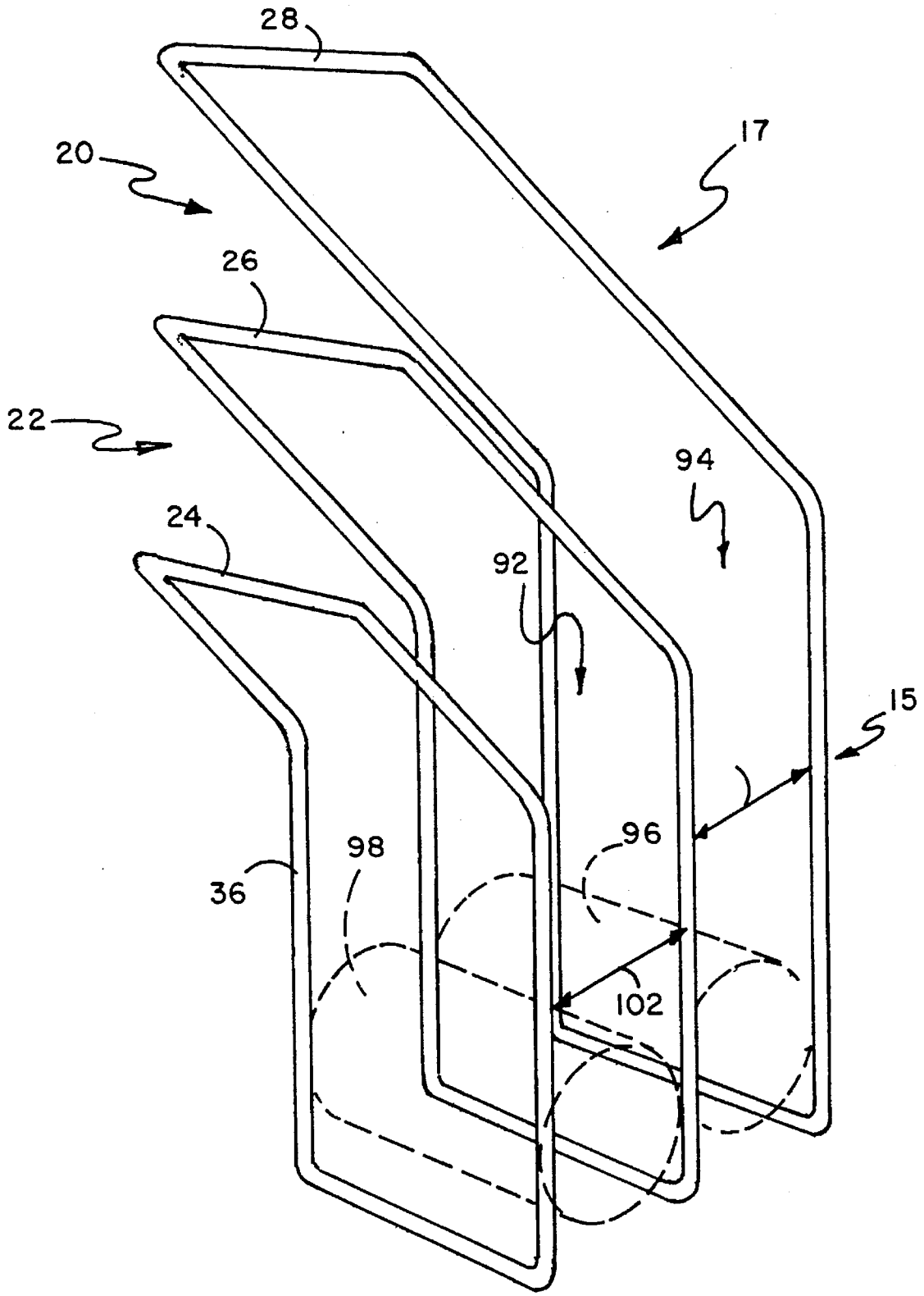
FIG. 3 illustrates a perspective view of the channel formers without other structure therearound, showing the angular portions and vertical portions of the channel formers and the channels therebetween for receipt of cans therein.

FIG. 3 illustrates the three channel formers being lower channel former 24, mid-channel former 26 and upper channel former 28 seen without the other wire supporting structure therearound. Seen in this view is upper channel entrance 20 to upper channel 94 and lower channel entrance 22 to lower channel 92. Cans are placed, for example, in upper channel 94 between upper channel former 28 and mid-channel former 26 and fall downward within upper channel 94 such that a can, such as can 96, would then be horizontally disposed at the bottom of upper channel 94 being retained therein by cross members such as first and second cross members 84 and 85 as seen in FIG. 1.

As seen in FIG. 3 adjacent channel formers are disposed a distance 100 apart from one another being spaced apart a distance somewhat wider than the diameter of can 96 to allow it to fall easily within its channel without being caught or hung up on any of the structural members as described further below. In the same manner, can 98 is seen disposed within lower channel 92 formed between mid-channel former 26 and lower channel former 24 and spaced apart from one another a distance 102 sufficient to receive can 98 therein such that it rests on first and second cross members 84 and 85 of the device as seen in FIG. 1. Subsequent cans will stack on top of the cans already in position within the channels until the device is full, with the cans coming right up to upper channel entrance 20 and lower channel entrance 22 at which point door 14 can be closed with door catch member 70 engaging against the upper portion of lower channel former 24. The device can then be transported without any possibility of the cans inadvertently falling out of the device.

Figure 2:
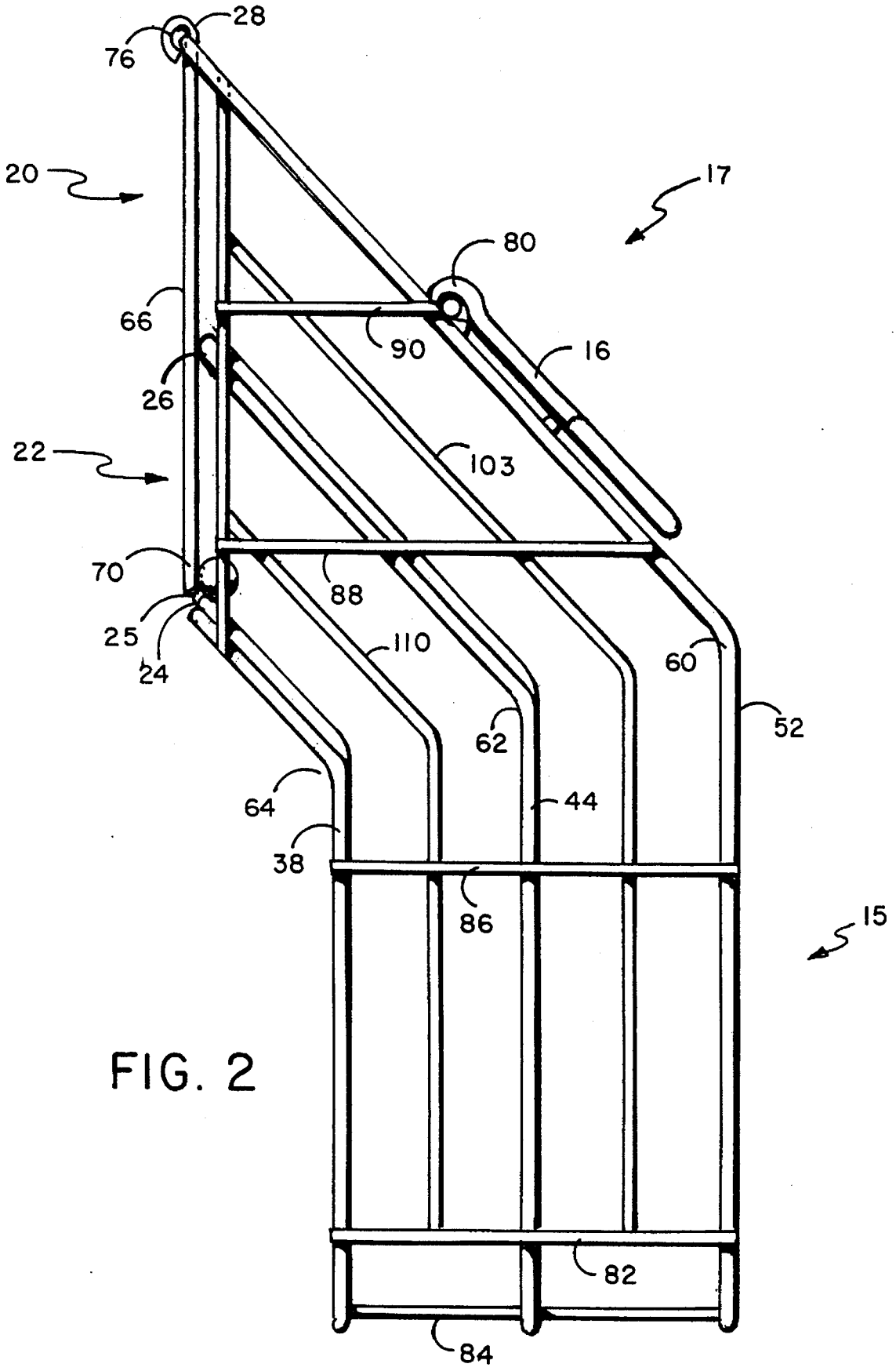
FIG. 2 illustrates a right side view of the structure of FIG. 1 with the door in a closed position.

As seen in FIG. 1, the upper channel entrance 20 and lower channel entrance 22 to are bounded laterally on each side vertically disposed right channel guide 32 and left channel guide 30 which are disposed apart from one another a distance somewhat greater than the length of the can such that the horizontally disposed cans can fit easily within the upper or lower channels. Each channel former such as lower channel former 24 is formed of several members on which the cans can rest as they roll down angular portion 17 of the device which device in one embodiment contains the cans when they fall further down in the upright vertically disposed portion 15 as seen in FIG. 2. Lower channel former 24 is made up of left member 36, right member 38 between which members are parallelly disposed first central member 40 and second central member 42. These central members prevent deposited cans from falling out between left member 36 and right member 38 of lower channel former 24. In the same way mid-channel former 26 is formed of left member 46 and right member 44 with first central member 48 and second central member 50 disposed parallelly therebetween, such members having the same functions as described regarding the members of lower channel former 24. Upper channel former 28 also has a right member 52 and left member 58 having first central member 54 and second central member 56 of upper channel former 28 spaced parallelly therebetween. Other configurations and different numbers of central members can be utilized as long as they act to prevent the cans from falling out between the left and right members of the channel formers and to support the cans as they roll down angular portions 17 of the can carrier to the vertical upright portions 15 of the can carrier. As can be seen, the vertical portions of the can carrier each have a height 18 in the embodiment shown which can be of a distance such that the entire height of the device is under 24 inches in height to allow placement of the device under a kitchen counter behind a cabinet door for convenient and neat storage of empty beverage cans. In some embodiments upright portion 15 of the structure depicted with height 18 can be significantly longer and be many feet high so that a greater quantity of cans can be stored therein. Such beverage can carrier storage unit can be used in commercial settings or even in home situations where more cans are desired to be stored and there is room for such a storage device. Along the sides of the beverage can carrier and storage device 10 can be disposed a plurality of rod members which are positioned substantially horizontal on each side thereof to help maintain the cans in position. Channel rod members are disposed at the mid-portion of each channel on each side, such as upper channel rod member 108 and lower channel rod member 110 which are seen in FIG. 2 and which run parallel to the channel formers and are disposed, respectively, midway between the upper channel former 28 and the mid-channel former 26 and midway between mid-channel former 26 and the lower channel former 24. These channel rod members aid in preventing the beverage cans from falling out the sides of the wire-formed structure. Similar channel rod members are also disposed on the opposite side of the device. The structure can also have attached thereto for additional strength and stability a plurality of horizontally disposed cross members such as first cross member 82, second cross member 86 disposed thereabove, third cross member 88 and fourth cross member 90 which extend across the channel formers and channel rod members. Similar cross members are also disposed on the other side of the device. At the bottom of the structure, as depicted in FIG. 1, are seen first and second bottom cross members 84 and 85 which catch the cans and prevent them from falling out the bottom of the device.

Figure 4:
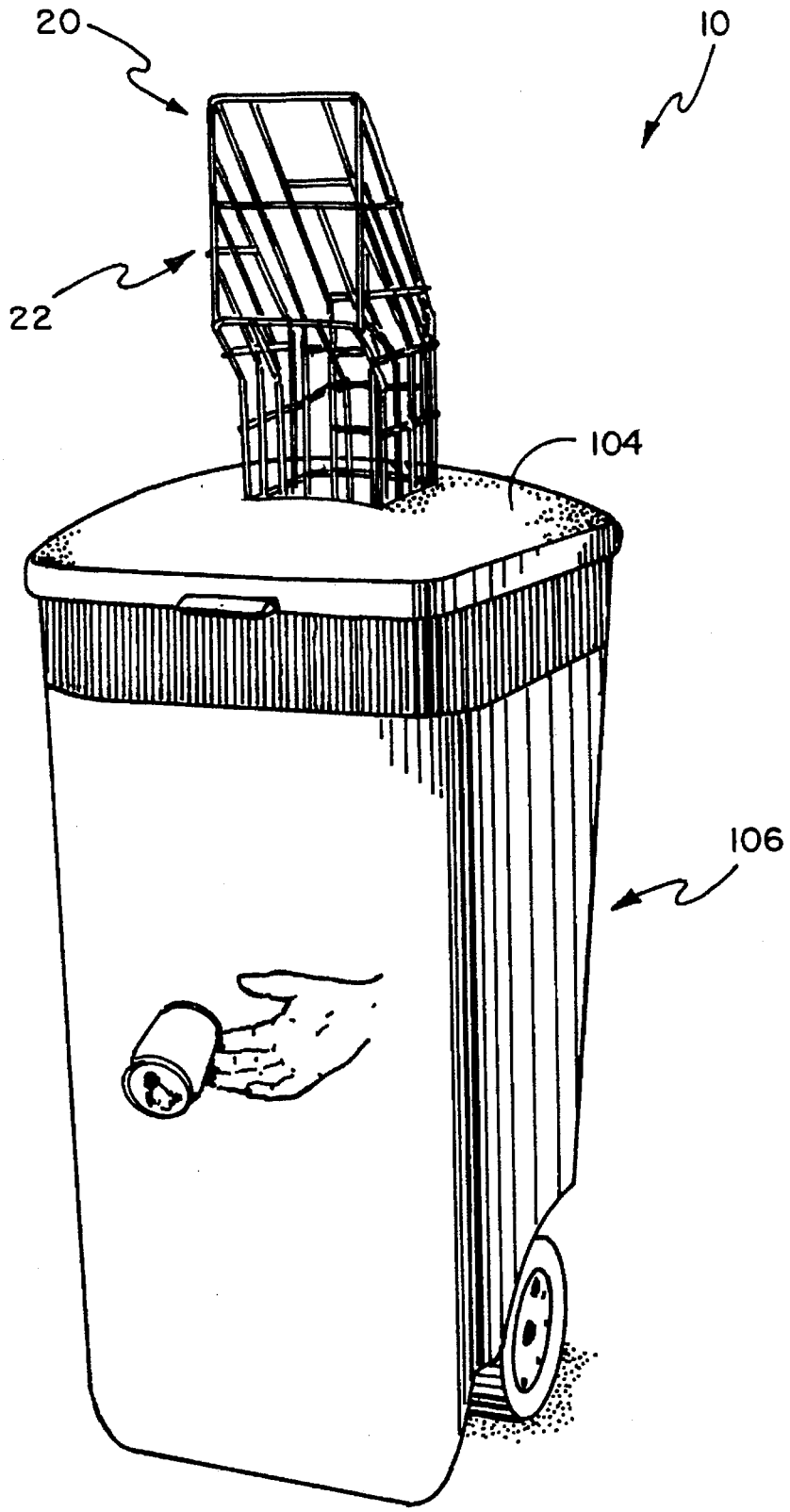
FIG. 4 illustrates a perspective view of the embodiment of the structure of this invention utilized for the introduction of cans into storage containers such as a barrel.

In an alternate embodiment of this invention such as seen in FIG. 4, such bottom cross members, such first and second cross members are not utilized so that cans positioned within the entrance to the upper channel 20 or entrance to the lower channel 22 fall down their respective channels laterally into container 106 through lid 104 to which the beverage can carrier and storage device 10 of this invention is attached. As mentioned above, the use of such device encourages the placement of cans only within containers such as barrels 106, that are designated solely for the collection of cans.

The channel formers as seen in FIG. 2 all are bent at a point at approximately a 45-degree angle so that the upper angular portions 17 of the structure are disposed at an angle to the lower vertical portions of the device. The entrances to the channels are structured such that the cans are horizontally deposited into the vertically disposed entrances. When the device is full of cans, door 14 can be closed thereover with door catch member 70 engaging against the upper portion 25 of lower channel former 24. Door 14 can be made also of wire with the top portion of right side 66 and left side 72 being bent around to form, respectively, first and second hook members 76 and 78 to hold it rotatably in place, as seen in FIGS. 1 and 2. Handle 16 can be attached to a cross member extending between first and second central members 54 and 56 of upper channel former 28 by attachment member 80, as seen in FIG. 1. Handle 16 can be rotated to a downward non-use storage position and rotated upwards to a carrying position where it can be easily grasped. Other equivalent handle means can be used to transport the device of this invention. The bends of the channel former members such as the bend 60 in upper channel former and in both its side and central members corresponds to bend 62 in the mid-channel former arid in its respective side members and central members and with bend 64 in the lower channel former in both its side and central members. These bends dispose the channels in the upper portion of the device at approximately a 45-degree angle to those in the lower portion of the device such that the entrance of cans into the upper channel 94 and lower channel 92, allows for the cans to first pass, rolling at an angle down the upper angular portion 17 of each channel to where it comes to the bends and then the cans drop in a vertical direction down to the vertical portion 15 of the device to the bottom of either the structure of the device itself or into a storage container such as described herein. Bends 60, 62 and 64 are best seen in FIG. 2 wherein bend 60 is slightly higher than bend 62 which is, in turn, slightly higher than bend 64.

Although the present invention has been described with reference to particular embodiments, it will be apparent to those skilled in the art that variations and modifications can be substituted therefor without departing from the principles and spirit of the invention.

I claim:

1. A structure for the storage and carrying of empty beverage cans, said cans each having a diameter and a length, comprising:

a wire form structure having a lower vertical portion and an upper angular portion having an upper end, said upper angular portion disposed at approximately a 45-degree angle to said lower vertical portion, said structure at its lower vertical portion including a lower channel former, a mid-channel former spaced apart and behind said lower channel former, and an upper channel former spaced apart and behind said mid-channel former defining, respectively, therebetween a lower channel and an upper channel, said channel formers having an upper angular portion said upper angular portion of each of said channel formers being bent parallel to one another at approximately a 45-degree angle to its respective lower vertical portion, said upper and lower channels being substantially parallel to one another, and said upper angular portion extending away from said lower vertical portion, said lower channel having a lower entrance defined at said upper end between said lower channel former and said mid-channel former, said upper channel having an upper entrance defined at said upper end between said mid-channel former and said upper channel former;

said lower and upper entrances being vertically disposed, respectively, in said lower channel and said upper channel with said upper entrance disposed immediately above said lower entrance for cans entered into said lower and upper entrances to pass first at approximately a 45-degree angle downward within said channels of said upper angular portion to where they reach said lower vertical portion and fall down into said channels in said lower vertical portion for storage.

2. The structure of claim 1 wherein said lower channel former includes side members and at least one central member, said mid-channel former includes side members and at least one central member, and said upper channel former includes side members and at least one central member, and wherein said upper entrance and said lower entrance are disposed in a vertical plane for said cans to be entered therein.

3. The structure of claim 2 having a door member hingeably attached to a portion of said upper channel former, said door rotatable down and covering said entrances to said upper channel and said lower channel so as to retain cans therein and further including latching means to releasably retain said door in a closed position.

4. The structure of claim 3 further including:

at least one cross member disposed at the base of said channels to retain a finite number of cans within said channels.

5. The structure of claim 3 wherein said structure is placeable above a storage member such as a barrel for receipt of a plurality of cans which pass through said channels.

6. The structure of claim 4 further including a handle member.

7. The structure of claim 6 wherein said channels have sides and further including a plurality of mid-channel formers positioned between said channel formers and a plurality of laterally disposed cross members along said sides of said channels.

8. The structure of claim 7 wherein said channels are of a width slightly greater than the height of a can and wherein said height of each channel is slightly greater than the diameter of each can.

9. A structure for the storage and carrying of empty beverage cans, said cans each having a diameter and a length, comprising:

a wire form structure having:

a lower channel former having a top, a left side, a right side, and a bottom, said left side and right side being bent, respectively, at approximately a 45-degree angle, said left and right sides in parallel alignment with one another;

a mid-channel former having a top, a left side, a right side, and a bottom, said left side and right side being bent, respectively, at approximately a 45-degree angle, said left and right sides in parallel alignment with one another;

an upper channel former having a top, a left side, a right side, and a bottom, said left side and right side being bent, respectively, at approximately a 45-degree angle, said left and right sides in parallel alignment with one another;

said lower channel former being spaced apart from said mid-channel former a distance slightly greater than the diameter of said can, said space therebetween defining a lower channel, said mid-channel former being spaced apart from said upper channel former a distance slightly greater than said diameter of said can, said space therebetween defining an upper channel, the portion of said channel formers disposed above said 45-degree bend defining an upper angular portion of said structure and the portion of said channel formers disposed below said 45-degree bend defining a lower vertical portion of said structure;

means disposed along said left and right sides, respectively, of said lower channel former, mid-channel former and upper channel former to prevent said cans from falling out of said channels;

means disposed between said respective left and right sides of said lower channel former, mid-channel former and upper channel former to prevent said cans from falling out of said channels; and vertically disposed upper and lower channel entrances at the upper portions of said upper angular portions of said upper and lower channels.

* * * * *